US006390908B1

(12) United States Patent
Chen et al.

(10) Patent No.: US 6,390,908 B1
(45) Date of Patent: May 21, 2002

(54) DETERMINING WHEN TO REPLACE A RETAINING RING USED IN SUBSTRATE POLISHING OPERATIONS

(75) Inventors: Hung Chih Chen, San Jose; Steven M. Zuniga, Soquel; Bret W. Adams, Sunnyvale; Manoocher Birang, Los Gatos; Kean Chew, Santa Clara, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/345,429

(22) Filed: Jul. 1, 1999

(51) Int. Cl.[7] ..... B24B 5/00; B24B 47/02

(52) U.S. Cl. ..... 451/398; 451/397; 451/288; 451/41; 451/8

(58) Field of Search ..... 451/6, 8, 21, 28, 451/41, 285, 287, 288, 289, 921, 526, 490, 527, 529, 539, 443, 444, 397, 398, 56; 15/230; 438/14; 156/345, 645.1

(56) References Cited

U.S. PATENT DOCUMENTS 5,695,392 A * 12/1997 Kim ..... 451/398
5,913,713 A * 6/1999 Cheek et al. ..... 451/41
5,944,593 A * 8/1999 Chiu et al. ..... 451/398
5,947,053 A * 9/1999 Burnham et al. ..... 116/208
5,967,885 A * 10/1999 Crevasse et al. ..... 451/398

* cited by examiner

*Primary Examiner*—Derris Holt Banks
(74) *Attorney, Agent, or Firm*—Fish & Richardson

(57) ABSTRACT

Apparatus and methods of polishing substrates are disclosed. A retaining ring for a polishing apparatus includes an inner surface exposed to contact a peripheral edge of a substrate to be polished against a polishing surface, a bottom surface exposed to contact the polishing surface while the substrate is being polished, and a wear marker indicative of a preselected amount of wear of the bottom surface. The inner surface, bottom surface and wear marker may form part of a retaining ring used in chemical mechanical polishing operations. In one method, one or more substrates may be polished against a polishing surface using the retaining ring, and at least a portion of the retainer may be replaced when the bottom surface has been worn away by the preselected amount indicated by the wear marker. In another method, one or more substrate may be polished against a polishing surface with a substrate carrier that includes a substrate retaining ring with a wear marker indicative of a preselected amount of wear of the retaining ring, and a warning signal may be generated upon detection of the wear marker.

25 Claims, 6 Drawing Sheets

DETERMINING WHEN TO REPLACE A RETAINING RING USED IN SUBSTRATE POLISHING OPERATIONS

BACKGROUND

This invention relates to apparatus and methods for determining when to replace a retaining ring used in substrate polishing operations (e.g., chemical-mechanical polishing).

Chemical mechanical polishing (CMP) is a process for planarizing the surface of a substrate (e.g., a semiconductor wafer). In a typical CMP process, a polishing surface of a polishing sheet (or pad) is covered with a slurry solution containing abrasive particles and one or more reactive chemicals. A substrate to be polished is held against the polishing surface by a carrier head in a recess defined by a substrate support surface and a retaining ring. The polishing surface and the carrier head are moved relative to one another causing the slurry to mechanically and chemically remove portions of the substrate surface.

The retaining ring serves to hold the substrate in position on the carrier head and improves the uniformity of the polishing process. During this process, however, the retaining ring is exposed to the polishing action of the slurry and, after a period of time, a significant portion of the retaining ring will have been worn away. After a certain amount of material has worn away, its ability to retain the substrate in place and its beneficial impact on polishing uniformity diminishes. Eventually, the retaining ring must be replaced to avoid detrimental impact on the quality and yield of the polishing process.

SUMMARY

In one aspect, the invention features a retaining ring. The retaining ring has an inner surface exposed to contact a peripheral edge of a substrate to be polished against a polishing surface, a bottom surface exposed to contact the polishing surface while the substrate is being polished, and a wear marker indicative of a preselected amount of wear of the bottom surface.

In another aspect, the invention features a substrate polishing apparatus that includes a carrier head configured to hold a substrate against a polishing surface, and a retaining ring having an inner surface exposed to contact a peripheral edge of the substrate, a bottom surface exposed to contact the polishing surface while the substrate is being polished, and a wear marker indicative of a preselected amount of wear of the bottom surface.

Embodiments may include one or more of the following features.

The wear marker may comprise a visual indicator that is located at the outer surface of the polishing apparatus and is exposed for visual inspection while the substrate is being polished. The visual indicator may comprise a color change. The color change may result from a change in material composition between the bottom surface and the location of the visual indicator, or from a colorant applied to the outer surface. The wear marker may comprise a change in a structural feature of the outer surface. The structural feature change may comprise a hole extending from the outer surface to the inner surface; the hole preferably extends in a linear direction oriented at an acute angle relative to the bottom surface. Alternatively, the structural feature change may comprise a continuous groove that defines a plane that is substantially parallel to the bottom surface.

The wear marker may be exposed for detection at the bottom surface after the bottom surface has been worn away by a preselected amount. The wear marker and the bottom surface may be formed from different material compositions. The wear marker may be formed from a polymeric material, or a metal. The material compositions of the wear marker and the bottom surface may have different reflectivity characteristics. For example, in one embodiment, the wear marker is formed from a metal and the bottom surface is formed from a polymeric material.

The bottom surface may include a groove having a characteristic depth, and the wear marker may be exposed for detection after the depth of the groove has been reduced sufficiently by wearing. The wear marker may comprise a metallic surface disposed in the groove, an annular ring, or one or more spaced-apart wear marker plugs.

A detection system may be provided. The detection system may be configured to detect the wear marker and to generate a warning signal upon detection of the wear marker.

In another aspect, the invention features a substrate polishing method, in which one or more substrates are polishing against a polishing surface with a retaining ring having an inner surface exposed to contact a peripheral edge of the substrate, a bottom surface exposed to contact the polishing surface while the substrate is being polished, and a wear marker indicative of a preselected amount of wear of the bottom surface. At least a portion of the retaining apparatus is replaced when the bottom surface has been worn away by the preselected amount indicated by the wear marker.

The invention also features a substrate polishing method, in which one or more substrates are polished against a polishing surface with a substrate carrier that includes a substrate retaining ring with a wear marker indicative of a preselected amount of wear of the retaining ring, and a warning signal is generated upon detection of the wear marker.

The wear marker may be detected optically.

Among the advantages of the invention are the following. The invention enables CMP operators to determine when a retaining ring should be replaced based upon a simple visual inspection of the retaining ring before, during or after a CMP process. The invention also provides a system for automatically determining when a retaining ring should be replaced. The invention allows retaining rings to be efficiently used without risk of the detrimental impact on process quality and yield that might be caused by using overly worn retaining rings. The invention reduces processing costs by reducing materials costs (in the form of reducing premature disposal of retaining rings) and by reducing labor costs (in the form of reducing CMP operator time required to monitor retaining ring life).

Other features and advantages will become apparent from the following description, including the drawings and the claims.

DETAILED DESCRIPTION

Figure 1:
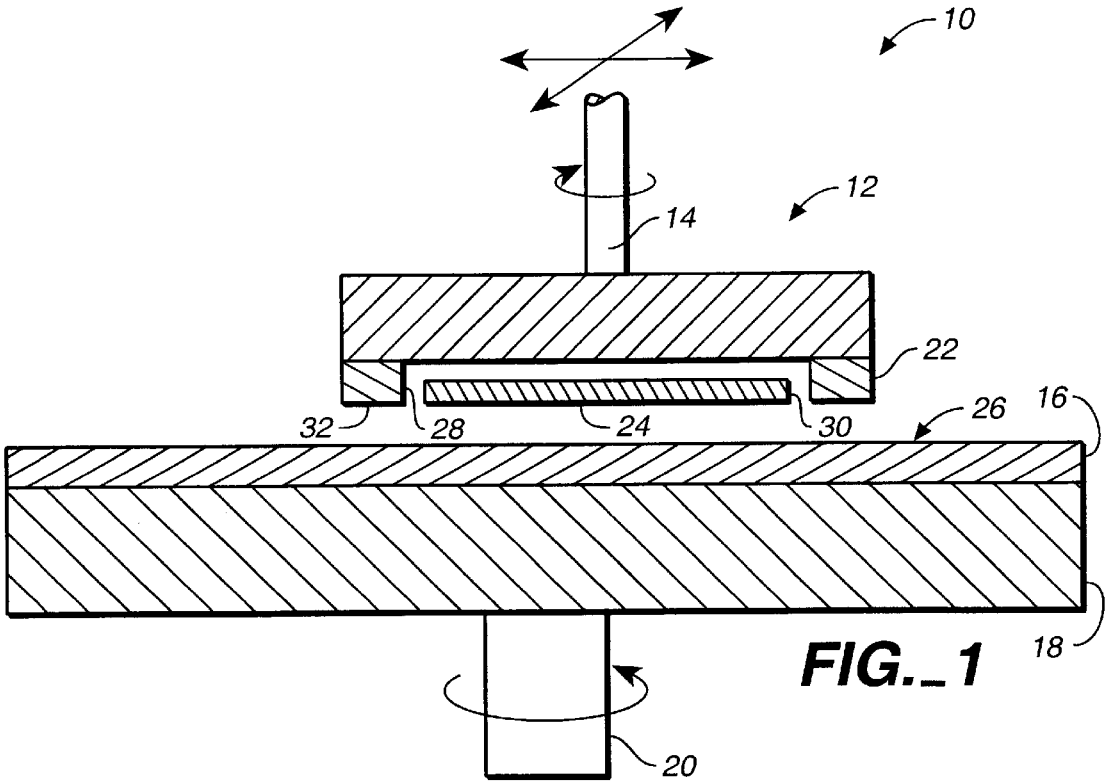
FIG. 1 is a diagrammatic side view, in partial cross-section, of a substrate polishing apparatus that includes a substrate carrier head, and a polishing pad mounted on a rotatable platen.

Referring to FIG. 1, a CMP polishing system 10 includes a carrier head 12 which is mounted to a rotatable shaft 14, a polishing pad 16, and a rotatable platen 18 which is mounted to a rotatable shaft 20. Carrier head 12 includes a retaining ring 22 configured to hold a substrate 24 in place on carrier head 12. In operation, carrier head 12 holds substrate 24 against a polishing pad 26 of polishing pad 16, while carrier head 12 and rotatable platen 18 independently rotate relative to one another. Carrier head 12 also may be moved back-and-forth across polishing pad 26 over a linear or nonlinear polishing path. A reactive slurry solution may be deposited on polishing pad 26 to enhance the polishing process.

Retaining ring 22 includes an inner surface 28 which is exposed to contact a peripheral edge 30 of substrate 24, and a bottom surface 32 which is exposed to contact polishing pad 26 while substrate 24 is being polished. As mentioned above, after retaining ring 22 has been exposed to the combined polishing action of polishing pad 26 and the reactive slurry solution for a period of time, retaining ring 22 will have become sufficiently worn that it no longer is able to adequately perform the functions of holding substrate 24 in place and improving the uniformity of the polishing process. At this point, retaining ring 22 should be replaced. As described in detail below, retaining ring 22 includes a wear marker that facilitates the determination of when retaining ring 22 should be replaced.

Figure 2:
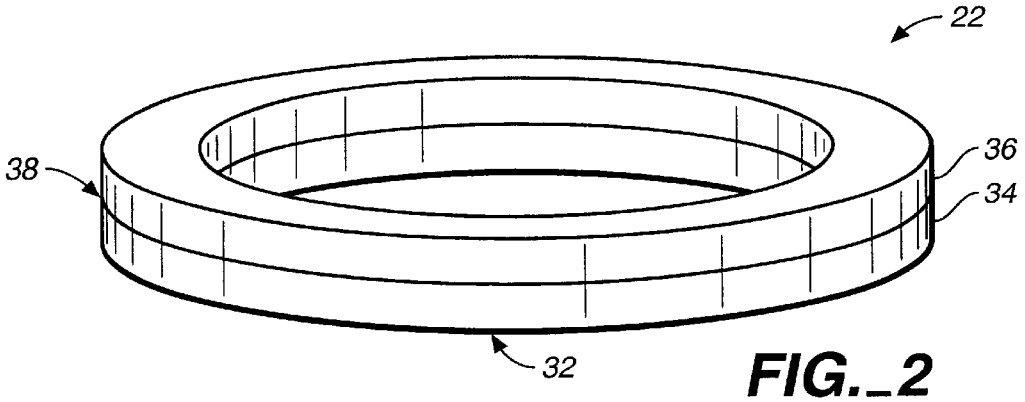
FIG. 2 is a diagrammatic perspective view of a retaining ring having a bottom layer and a top layer formed from different material compositions.

Referring to FIG. 2, in one embodiment, retaining ring 22 includes a bottom (or wear) layer 34 and a top (or support) layer 36. A wear marker 38 includes a visual indicator that is located at the outer surface of retaining ring 22 and is exposed for visual inspection while substrate 24 is being polished. In this embodiment, wear marker 38 consists of a color change between bottom layer 34 and top layer 36; these layers are formed from different material compositions. Bottom layer 22 is formed from a material, such as a fiber-reinforced TEFLON® matrix (e.g., a ZYMAXX® component available from DuPont) which may contact polishing pad 26 of polishing pad 16 without detrimental impact. Top layer 36 preferably also is formed from a material, such as a fiber-reinforced TEFLON® matrix, which may contact polishing pad 26 without a detrimental impact. The different colors of bottom layer 34 and top layer 36 may be achieved by embedding different fibers in the TEFLON® matrix. For example, layer 34 may appear black as a result of carbon fibers embedded in the matrix, and top layer 36 may appear beige as a result of KEVLAR® fibers embedded in the matrix.

Other combinations of materials may be used to form top and bottom layers 36, 34. Also, more than two layers of different color may be used. For example, there may be one or more intermediate layers disposed between bottom layer 34 and top layer 36; the intermediate layers may be of different color to provide multiple warning indications to a CMP operator. Each layer may correspond to a preselected amount by which retaining ring 22 has been worn away, and each layer may indicate a time when retaining ring 22 should be replaced for a particular set of CMP process tolerance parameters. For example, an intermediate layer that is close to bottom layer 34 may indicate when retaining ring 22 should be replaced when used in a CMP process that has relatively demanding tolerance parameters, whereas an intermediate layer that is closer to top layer 36 may indicate when retaining ring 22 should be replaced when used in a CMP process that has less demanding tolerance parameters.

The thickness of bottom layer 34 (and therefore the location of wear marker 38) is selected to correspond to the amount by which bottom surface 32 of retaining ring 22 may be worn away before the performance of retaining ring 22 is significantly degraded. This amount may vary depending upon the nature of the polishing process (e.g., the rate at which retaining ring 22 is worn away), polishing tolerances, and the particular impact of the gradual thinning of retaining ring 22 on the polishing process.

In operation, a CMP operator may visually inspect the outer surface of retaining ring 22 before, during or after a CMP process, and when the color of bottom layer 34 is no longer visible, the operator may replace retaining ring 22. Alternatively, when used in substrate polishing system 87 (described below in connection with FIG. 8), the polishing system automatically may detect when retaining ring 22 should be replaced. For example, if the reflectivity of bottom layer 34 is different from the reflectivity of top layer 36, the polishing system would detect when bottom layer 34 has been worn away based upon a change in detected signal intensity at the location of retaining ring 22. To achieve a difference in reflectivity, for example, bottom layer 34 may be formed from a thermoplastic, such as PPS® mechanical plastic (available from Interstate Plastic, Inc. of Sacramento, Calif., U.S.A.) or a polyurethane composition, and top layer 36 may be formed from a metal (e.g., aluminum or stainless steel). Alternatively, bottom layer 34 and top layer 36 may be formed from different color materials.

Figure 3:
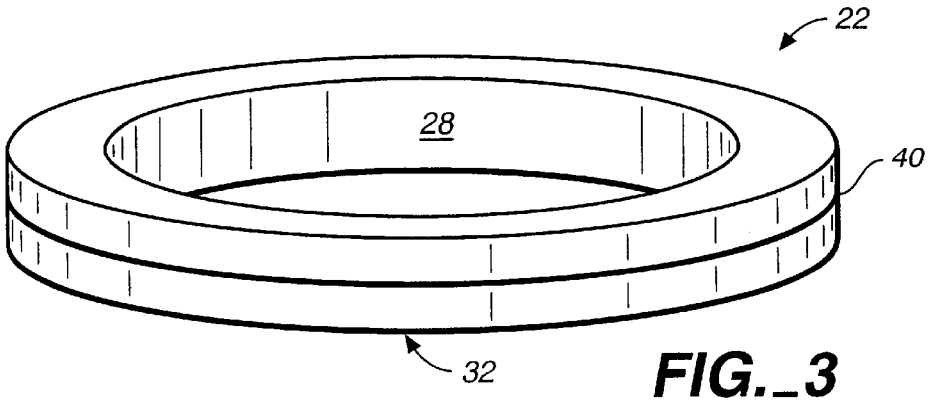
FIG. 3 is a diagrammatic perspective view of a retaining ring with a wear marker consisting of a colored ring disposed around the outer surface of the retaining ring.

As shown in FIG. 3, in another embodiment, a wear marker 40 consists of a ring of a substance that defines a plane that is substantially parallel to bottom surface 32 and has a different color than the substance forming retaining ring 22. For example, retaining ring 22 may be formed from a light-colored polyurethane material and wear marker 40 may be formed from a dark colorant (e.g., a paint or a dye) applied (or injected into) the outer surface of retaining ring 22. In operation, a CMP operator may visually inspect the outer surface of retaining ring 22 before, during or after a CMP process, and when wear marker 40 is no longer visible, the operator may replace retaining ring 22.

Figure 4A:
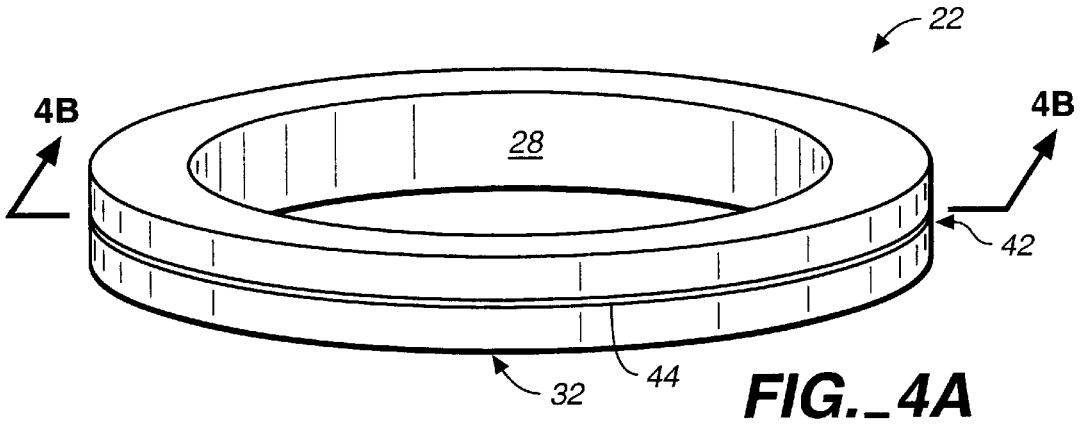
FIG. 4A is a diagrammatic perspective view of a retaining ring with a wear marker consisting of a groove disposed around the outer surface of the retaining ring.
Figure 4B:
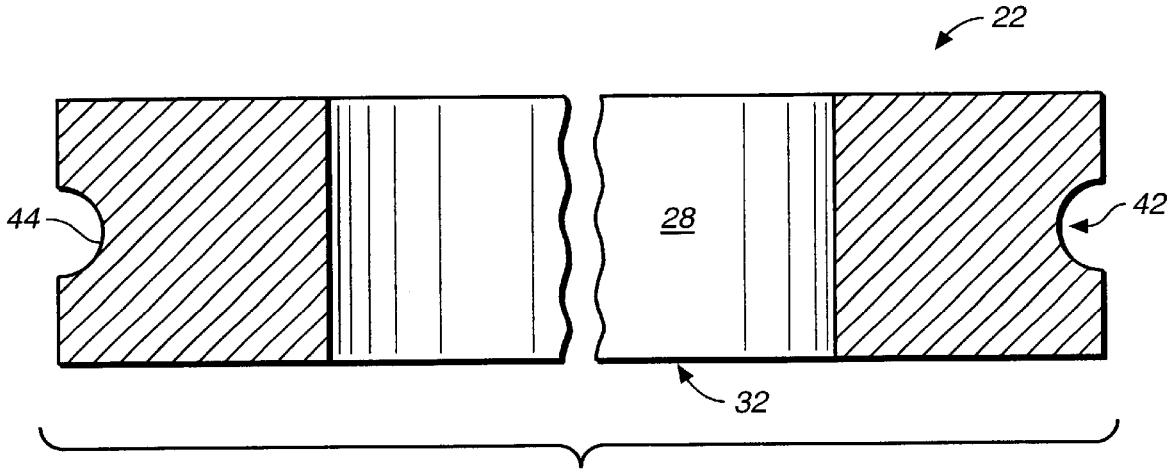
FIG. 4B is a diagrammatic cross-sectional side view of the retaining ring of FIG. 4A taken along the line 4B—4B.

Referring to FIGS. 4A and 4B, in another embodiment, a wear marker 42 consists of an annular groove 44 that is formed in the outer surface of retaining ring 22 and defines a plane that is substantially parallel to bottom surface 32. The location of annular groove 44 (and therefore the location of wear marker 42) is selected to correspond to the amount by which bottom surface 32 of retaining ring 22 may be worn away before the performance of retaining ring 22 is significantly degraded. Retaining ring 22 may be replaced when a CMP operator visually observes that bottom surface 32 of retaining ring 22 has been worn away up to groove 44.

Figure 5A:
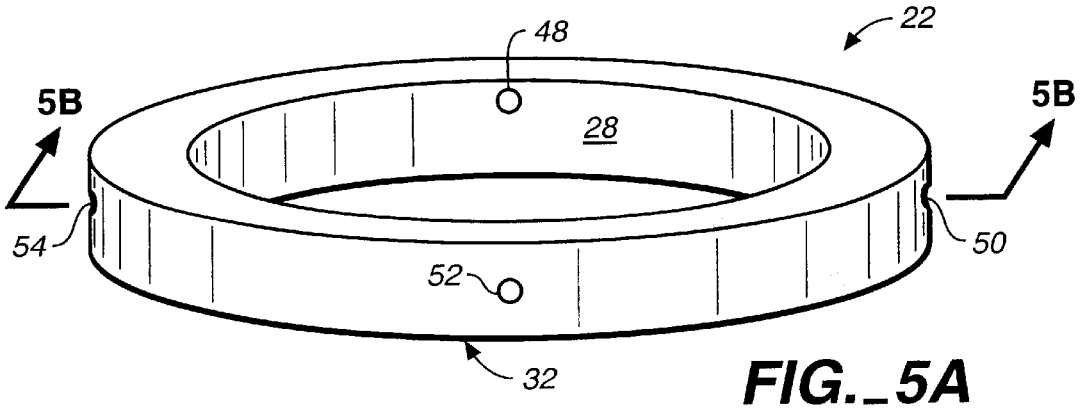
FIG. 5A is a diagrammatic perspective view of a retaining ring with a wear marker consisting of a plurality of vent holes extending from the outer surface to the inner surface of the retaining ring.
Figure 5B:
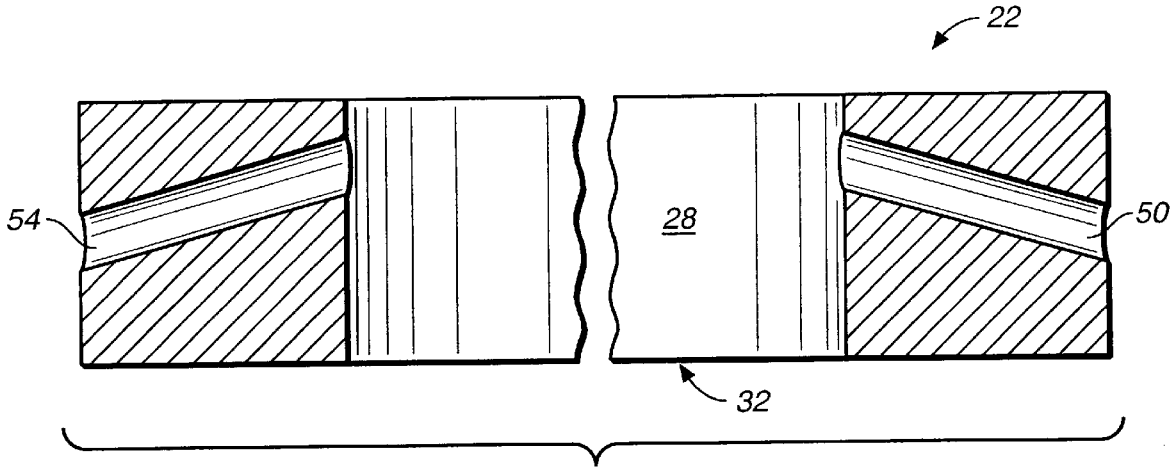
FIG. 5B is a diagrammatic cross-sectional side view of the retaining ring of FIG. 5A taken along the line 5B—5B.

As shown in FIGS. 5A and 5B, in another embodiment, a wear marker 46 may consist of one or more angled vent holes 48, 50, 52 and 54, that extend from the outer surface of retaining ring 22 to inner surface 28. Vent holes 48–54 preferably extend in a linear direction from the outer surface of retaining ring 22 to inner surface 28 and are oriented at an acute angle relative to bottom surface 32, as shown. The locations where vent holes 48–52 appear in the outer surface of retaining ring 22 (and therefore the location of wear marker 46) is selected to correspond to the amount by which bottom surface 32 of retaining ring 22 may be worn away before the performance of retaining ring 22 is significantly degraded. Retaining ring 22 may be replaced when a CMP operator visually observes that bottom surface 32 of retaining ring 22 has been worn away up to the locations where vent holes 48–54 are formed in the outer surface of retaining ring 22. Because the vent holes are angled, the polishing pad is exposed to only a portion of the groove that is formed after bottom surface 32 of retaining ring 22 has been worn away up to the locations where vent holes 48–54 are formed in the outer surface of retaining ring 22.

Figure 6A:
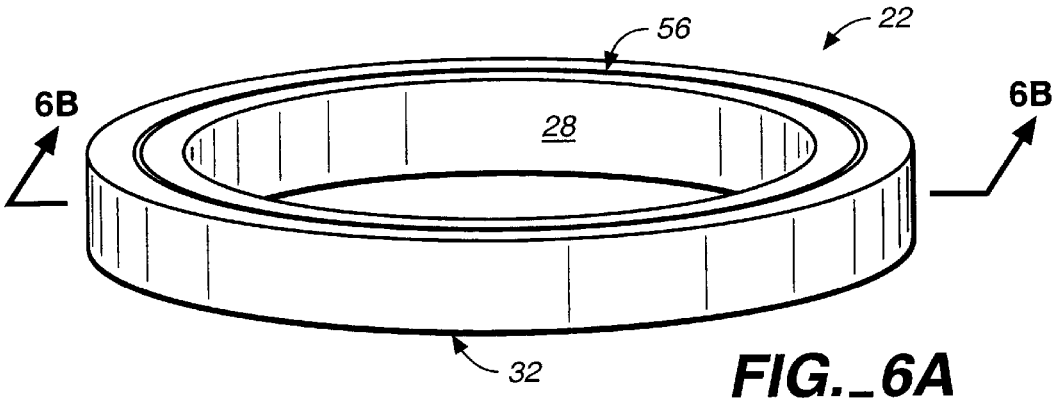
FIG. 6A is a diagrammatic perspective view of a retaining ring having an internal annular ring of one material (or color) embedded in a retaining ring of a different material (or color).
Figure 6B:
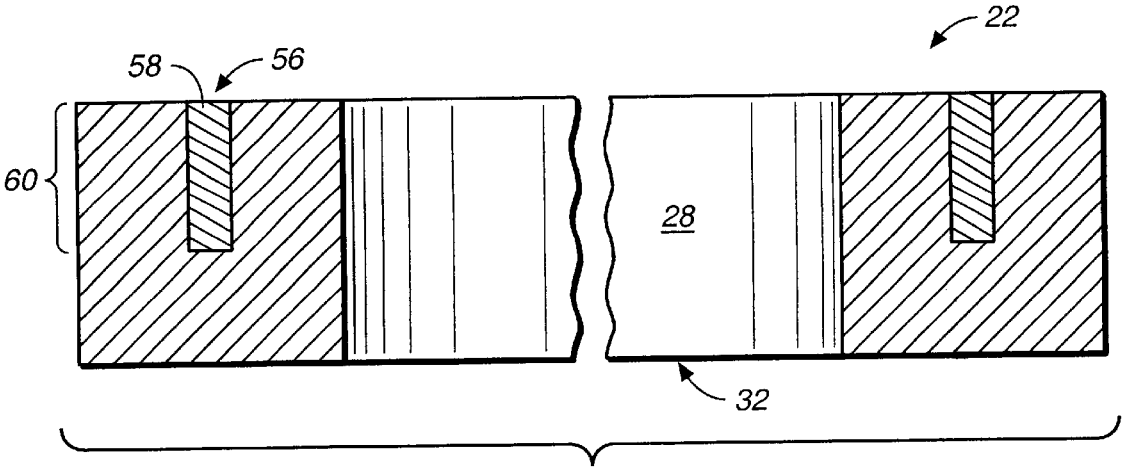
FIG. 6B is a diagrammatic cross-sectional side view of the retaining ring of FIG. 6A taken along the line 6B—6B.

Referring to FIGS. 6A and 6B, another retaining ring embodiment includes a wear marker 56 that is exposed for detection at bottom surface 32 of retaining ring 22 after bottom surface 32 has been worn away by a preselected amount. In this embodiment, wear marker 56 is formed from an internal ring 58 embedded within retaining ring 22. Internal ring 58 is formed from material that is different from the material composition of retaining ring 22. Retaining ring 22 may formed from a material, such as a fiber-reinforced TEFLON® matrix (e.g., a ZYMAXX® component available from DuPont) which may contact polishing pad 26 of polishing pad 16 without detrimental impact. Internal ring 58 preferably also is formed from a material, such as a fiber-reinforced TEFLON® matrix, which may contact polishing pad 26 without a detrimental impact. The different detection characteristics of internal ring 58 and retaining ring 22 may be achieved by embedding different fibers in the TEFLON® matrices. For example, internal ring 58 may appear black as a result of carbon fibers embedded in the matrix, and retaining ring 22 may appear beige as a result of KEVLAR® fibers embedded in the matrix. In an alternative embodiment, retaining ring 22 may be formed from a polymeric material (e.g., polyurethane) and internal ring 58 may be formed from a metal (e.g., aluminum or stainless steel).

Internal ring 58 extends into retaining ring 22 a depth 60 that is selected to correspond to the amount by which bottom surface 32 of retaining ring 22 may be worn away before the performance of retaining ring 22 is significantly degraded. As mentioned above, this amount may vary depending upon the nature of the polishing process (e.g., the polishing rate of retaining ring 22), polishing tolerances, and the particular impact of the gradual thinning of retaining ring 22 on the polishing process.

In operation, a CMP operator may visually inspect bottom surface 32 of retaining ring 22 before or after a CMP process, and when the bottom surface of internal ring 58 appears, the operator may replace retaining ring 22. Alternatively, when used in substrate polishing system 87 (described below in connection with FIG. 8), the polishing system automatically may detect when retaining ring 22 should be replaced. For example, if the reflectivity of internal ring 58 is different from the reflectivity of retaining ring 22 (e.g., when internal ring 58 is formed from a metal and retaining ring 22 is formed from a polymeric material), the polishing system would detect when bottom surface 32 has been sufficiently worn away based upon a change in detected signal intensity at the location of retaining ring 22.

In an alternative embodiment, internal ring 58 may be replaced by one or more spaced-apart wear marker plugs (or pins) that are formed from a material that is different from the material composition of retaining ring 22. These wear marker plugs may be distributed along an annular path corresponding to the location of internal ring 58 and may extend into retaining ring 22 the same depth as internal ring 58.

Figure 7A:
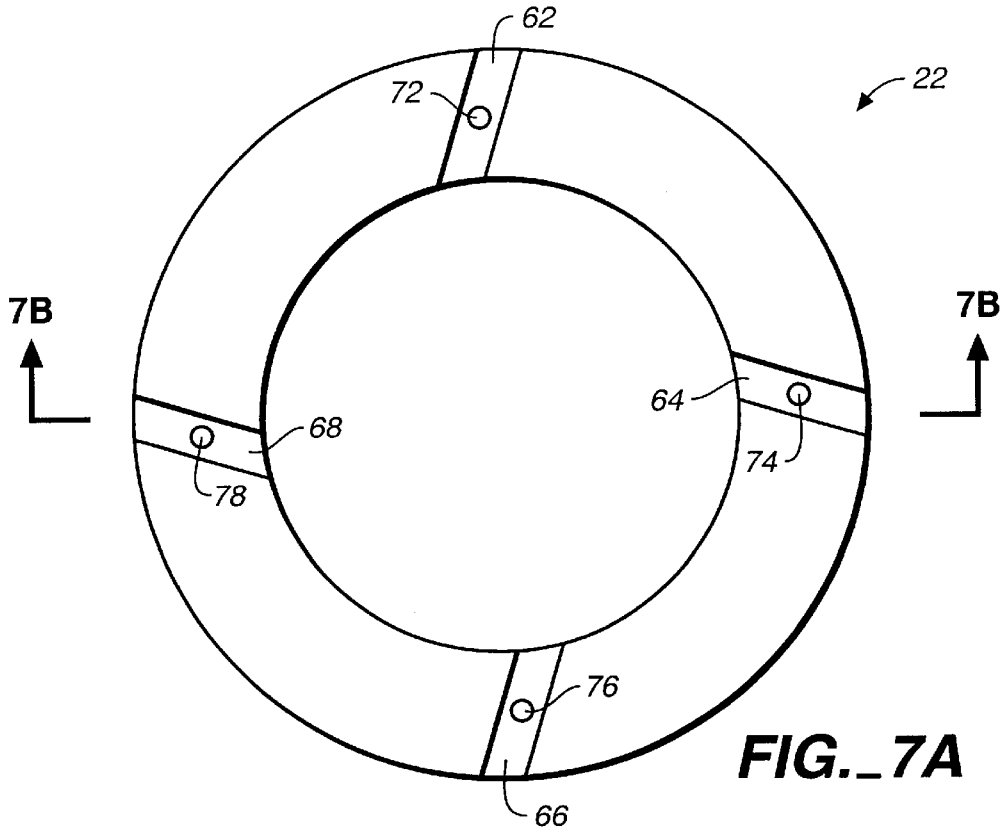
FIG. 7A is a diagrammatic bottom view of a grooved retaining ring with a wear marker consisting of a plurality of cylindrical wear markers disposed in the grooves of the retaining ring.
Figure 7B:
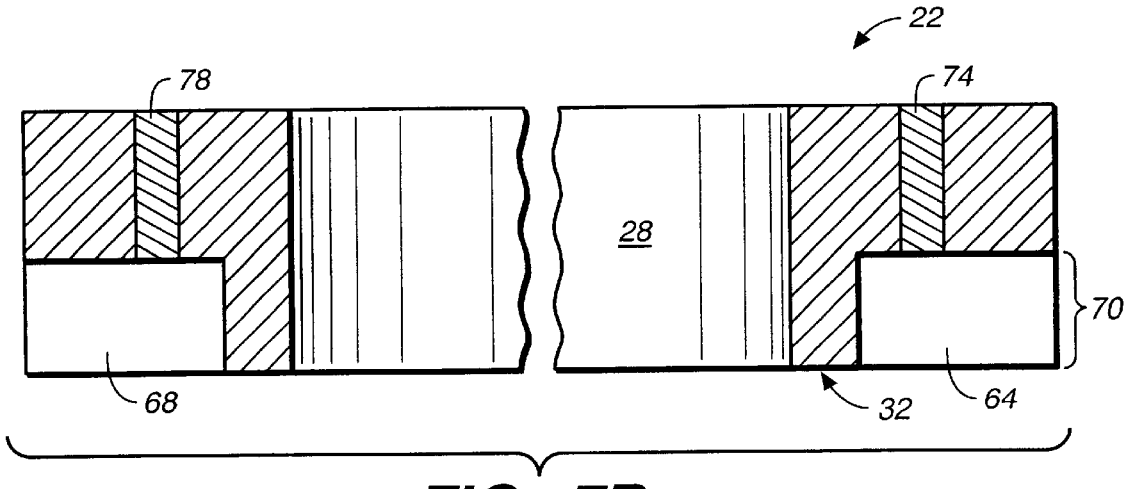
FIG. 7B is a diagrammatic cross-sectional side view of the retaining ring of FIG. 7A taken along the line 7B—7B.

Referring to FIGS. 7A and 7B, in another embodiment, retaining ring 22 includes a plurality of angled grooves 62, 64, 66 and 68, each having a characteristic depth 70, and a wear marker consisting of a plurality of spaced-apart wear marker plugs (or pins) 72, 74, 76 and 78 that are formed from a material that is different from the material composition of retaining ring 22. Plugs 72–78 are exposed for detection (e.g., by automatic optical detection) after the depth of the groove has been reduced sufficiently by wearing—this depth may be less than characteristic depth 70. Plugs 72–78 are formed from material that is different from the material composition of retaining ring 22. Retaining ring 22 may formed from a material, such as a fiber-reinforced TEFLON® matrix (e.g., a ZYMAXX® component available from DuPont), which may contact polishing pad 26 of polishing pad 16 without detrimental impact. Plugs 72–78 preferably also are formed from a material, such as a fiber-reinforced TEFLON® matrix, which may contact polishing pad 26 without a detrimental impact. The different detection characteristics of plugs 72–78 and retaining ring 22 may be achieved by embedding different fibers in the TEFLON® matrices. For example, plugs 72–78 may appear black as a result of carbon fibers embedded in the matrix, and retaining ring 22 may appear biege as a result of KEVLAR® fibers embedded in the matrix. In an alternative embodiment, retaining ring 22 may be formed from a polymeric material (e.g., polyurethane) and plugs 72–78 may be formed from a metal (e.g., aluminum or stainless steel).

In an alternative embodiment, wear marker plugs 72–78 may be replaced by layers (or coatings) of a material that is of a different material composition than retaining ring 22 and is disposed along the bottom surface of grooves 62–68. Suitable layers include layers that produce an initial optical response at a time before bottom surface 32 has been worn away that is different from the optical response produced when retaining ring 22 has been sufficiently worn that it should be replaced. For example, these layers may be formed from a reflective material (e.g., aluminum or stainless steel).

In operation, when used in the substrate polishing system described below in connection with FIG. 8, the polishing system automatically may detect when retaining ring 22 should be replaced. For example, if the optical characteristics of plugs 72–78 are different from the optical characteristics of retaining ring 22 (e.g., when plugs 72–78 are formed from a metal and retaining ring 22 is formed from a polymeric material), the polishing system would detect when bottom surface 32 has been sufficiently worn away based upon a change in detected optical signal intensity at the location of plugs 72–78. Specifically, as the bottom surface of retaining ring 22 is worn away, plugs 72–78 move closer to window 90, resulting in a change in the detected optical signal intensity.

Figure 7C:
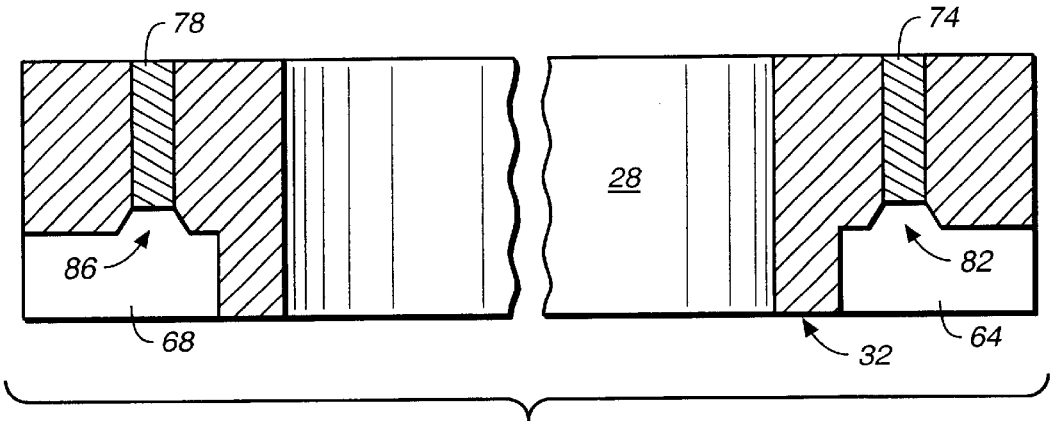
FIG. 7C is a diagrammatic cross-sectional side view of an alternative grooved retaining ring with a wear marker consisting of a plurality of cylindrical wear markers disposed in the grooves of the retaining ring.

As shown in FIG. 7C, plugs 72–78 may be sunk into respective recesses 80, 82, 84 and 86 in grooves 62–68 in order to improve the signal to noise ratio of the detected optical signal, or to prevent plugs 72–78 from contacting polishing pad 26 of polishing pad 16, or both.

Figure 8:
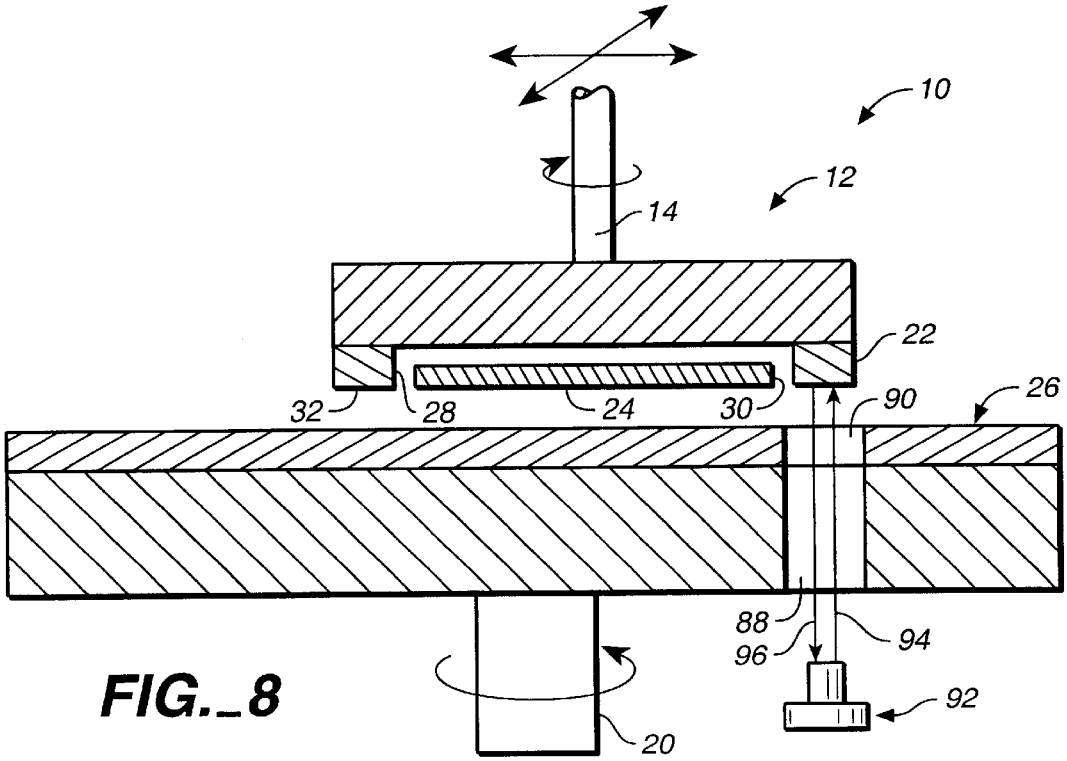
FIG. 8 is a diagrammatic side view of a substrate polishing system that includes a substrate carrier head, a polishing pad mounted on a rotatable platen, and an optical detection system.

Referring to FIG. 8, in one embodiment, platen 18 of substrate polishing system 10 includes a light passage 88 and polishing pad 16 includes a window 90 formed from a material (e.g., polyurethane) that is at least semi-transparent (substantially transmissive) with respect to the light produced by a monitoring system 92. In operation, monitoring system 92 produces a laser beam 94, e.g., at least a portion of which passes through light passage 88 and window 90. A portion of beam 94 is partially reflected from one or more layers of substrate 24 and retaining ring 22 to produce a beam 96 which has an intensity that varies as layers are removed from substrate 24 and varies as the optical characteristics (e.g., reflectivity) of retaining ring 22 change over time. For example, if the surface layer of substrate 24 is partially reflective and partially transmissive, beam 96 will be formed from at least two beams reflecting from different surfaces and the intensity of beam 96 will vary depending on whether the constituent beams interfere constructively or destructively, a characteristic which is primarily a function of the thickness of the surface layer of substrate 24. If the surface layer is substantially reflective, the intensity of beam 96 will be significantly reduced when the surface layer has been polished away. Monitoring system 92 monitors the variation in the intensity of beam 96 during a polishing process to determine the amount of material that has been removed from the surface of substrate 24, to determine the end point of the polishing process, and to determine when retaining ring 22 should be replaced. The operation of monitoring system 92 is coordinated with the movement of carrier head 12 to enable monitoring system 92 to periodically probe substrate 24. In particular, monitoring system 92 is configured to trigger the laser when substrate 24 is positioned over window 90; alternatively, monitoring system 92 may be configured to open a shutter over the detector when substrate 24 is positioned over window 90.

Figure 9A:
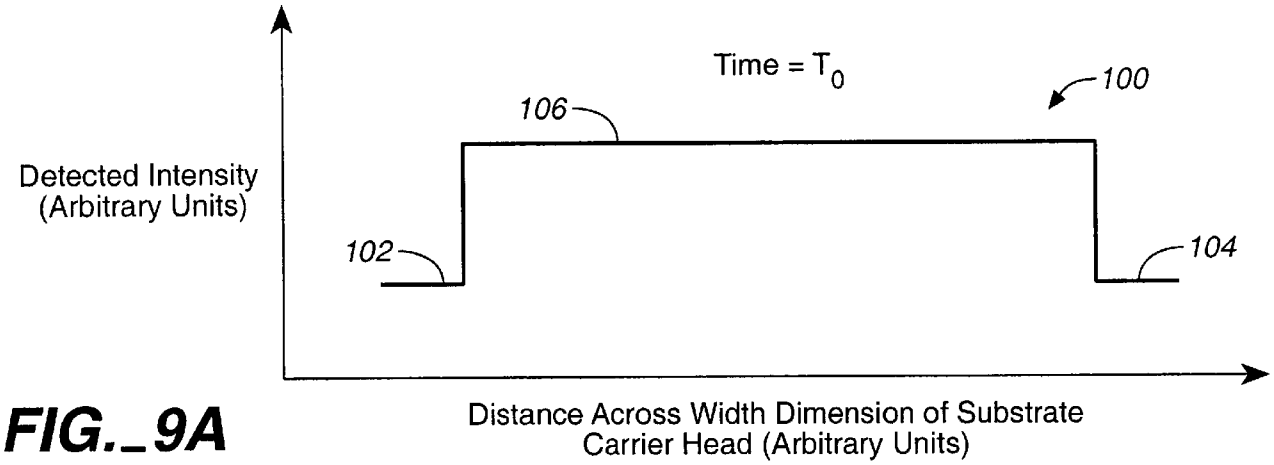
FIGS. 9A and 9B are graphs of the intensity of light detected by the optical detection system of FIG. 8 plotted against the distance across the width dimension of the substrate carrier head.
Figure 9B:
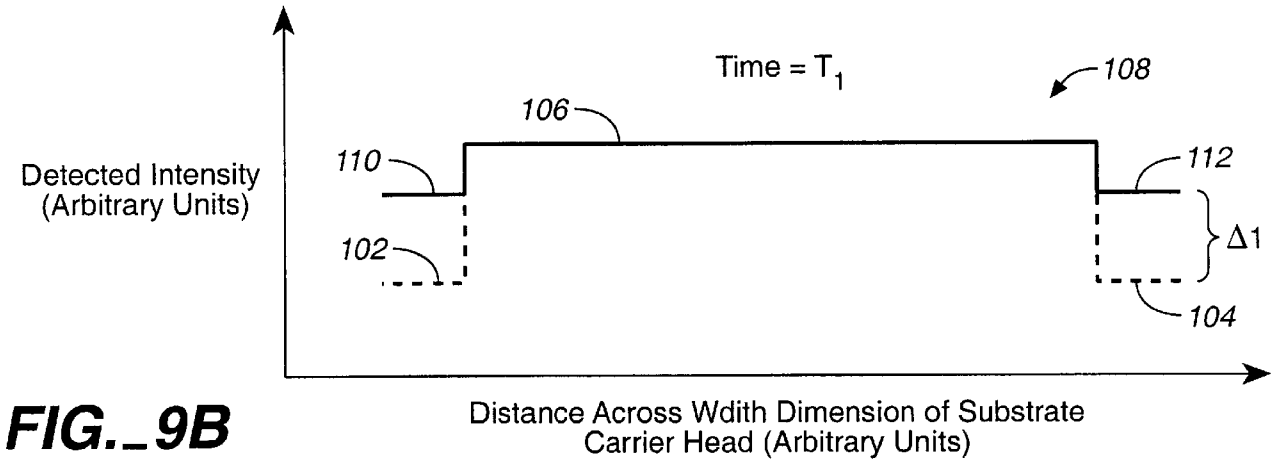

Referring to FIGS. 9A and 9B, monitoring system 92 automatically may determine when to replace retaining ring 22 as follows. At an initial time $T_0$ (before retaining ring 22 should be replaced), monitoring system 92 detects the intensity of beam 96 across the width dimension of carrier head 12. The resulting intensity distribution 100 is characterized by a relatively low (or high) intensity at the locations 102, 104 corresponding to retaining ring 22 and by a relatively high (or low) intensity at the locations 106 corresponding to substrate 24. At a later time $T_1$ (after retaining ring 22 has been sufficiently worn away that it should be replaced, usually after 1,500–4,000 substrates have been polished), the resulting intensity distribution 108 detected by monitoring system 92 is characterized by a higher $+|\Delta I|$ (or lower $-|\Delta I|$) detected intensity at the locations corresponding to retaining ring 22 relative to the intensity detected at time $T_0$. Once the detected intensity (110, 112) of the light received from retaining ring 22 exceeds (or is lower than) the initial intensity (102, 104) by more than a selected threshold (i.e., $|\Delta I|>I_{Threshold}$), monitoring system 92 generates a warning signal indicating that retaining ring 22 should be replaced. It should be noted that the threshold ($I_{Threshold}$) selected will depend upon the characteristics of retaining ring 22, the type and composition of wear marker used, and the characteristics of monitoring system 92. Also, it should be noted that the detected intensity of light received from retaining ring 22 may exceed (or be lower than) the detected intensity of light received from substrate 24 depending upon the optical characteristics of substrate 24, retaining ring 22 and the wear marker used.

Other embodiments are within the scope of the claims. The invention may be implemented with other substrate polishing designs. For example, rotatable platen 18 and polishing pad 16 may be implemented with a different rotating polishing system design, or may be replaced by a linear drive mechanism and a linear polishing pad.

Monitoring system 92 may be configured to direct beam 94 at the outer surface of retaining ring 22. This configuration may be used in combination with the embodiments of FIGS. 2–5B to detect changes in the optical characteristics of the outer surface of retaining ring 22 as bottom surface 32 is being worn away.

Still other embodiments are within the scope of the claims.

What is claimed is:

1. A retaining ring, comprising:

an inner surface exposed to contact a peripheral edge of a substrate to be polished against a polishing surface;

a bottom surface exposed to contact the polishing surface while the substrate is being polished; and a wear marker indicative of a preselected amount of wear of the bottom surface.

2. The retaining ring of claim 1, further comprising an outer surface, wherein the wear marker comprises a visual indicator that is located at the outer surface on a side perpendicular to the bottom surface of the retaining ring and is exposed for visual inspection while the substrate is being polished.

3. The retaining ring of claim 2, wherein the visual indicator comprises a color change.

4. The retaining ring of claim 3, wherein the color change results from a change in material composition between the bottom surface and the location of the visual indicator.

5. The retaining ring of claim 3, wherein the color change results from a colorant applied to the outer surface.

6. The retaining ring of claim 2, wherein the wear marker comprises a change in a structural feature of the outer surface.

7. A retaining ring comprising:

an inner surface exposed to contact a peripheral edge of a substrate to be polished against a polishing surface;

a bottom surface exposed to contact the polishing surface while the substrate is being polished;

a wear marker indicative of a preselected amount of wear of the bottom surface, the wear marker comprising a visual indicator that is located at the outer surface and is exposed for visual inspection while the substrate is being polished; and an outer surface, wherein the wear marker further comprises a change in a structural feature of the outer surface and wherein the structural feature change comprises a hole extending from the outer surface to the inner surface.

8. The retaining ring of claim 7, wherein the hole extends in a linear direction oriented at an acute angle relative to the bottom surface.

9. A retaining ring comprising:

an inner surface exposed to contact a peripheral edge of a substrate to be polished against a polishing surface;

a bottom surface exposed to contact the polishing surface while the substrate is being polished;

a wear marker indicative of a preselected amount of wear of the bottom surface, the wear marker comprising a visual indicator that is located at the outer surface and is exposed for visual inspection while the substrate is being polished; and an outer surface, wherein the wear marker further comprises a change in a structural feature of the outer surface and wherein the structural feature change comprises a continuous groove that defines a plane that is substantially parallel to the bottom surface.

10. A retaining ring comprising:

an inner surface exposed to contact a peripheral edge of a substrate to be polished against a polishing surface;

a bottom surface exposed to contact the polishing surface while the substrate is being polished;

a wear marker indicative of a preselected amount of wear of the bottom surface; and an outer surface, wherein the wear marker is exposed for detection at the bottom surface after the bottom surface has been worn away by a preselected amount.

11. The retaining ring of claim 10, wherein the wear marker and the bottom surface are formed from different material compositions.

12. The retaining ring of claim 11, wherein the wear marker is formed from a polymeric material.

13. The retaining ring of claim 11, wherein the wear marker is formed from a metal.

14. The retaining ring of claim 11, wherein the material compositions of the wear marker and the bottom surface have different reflectivity characteristics.

15. The retaining ring of claim 14, wherein the wear marker is formed from a metal and the bottom surface is formed from a polymeric material.

16. The retaining ring of claim 10, wherein the bottom surface comprises a groove having a characteristic depth and the wear marker is exposed for detection after the depth of the groove has been reduced sufficiently by wearing.

17. The retaining ring of claim 16, wherein the wear marker comprises a metallic surface disposed in the groove.

18. The retaining ring of claim 16, wherein the wear marker comprises an annular ring.

19. The retaining ring of claim 16, wherein the wear marker comprises one or more spaced-apart wear marker plugs.

20. A retaining ring, comprising:

inner surface means for contacting a peripheral edge of a substrate to be polished against a polishing surface;

bottom surface means for contacting the polishing surface while the substrate is being polished; and wear marker means for indicating that the bottom surface has been worn away by a preselected amount.

21. A substrate polishing apparatus, comprising:

a carrier head configured to hold a substrate against a polishing surface;

a retaining ring having an inner surface exposed to contact a peripheral edge of the substrate, a bottom surface exposed to contact the polishing surface while the substrate is being polished, and a wear marker indicative of a preselected amount of wear of the bottom surface.

22. The apparatus of claim 19, further comprising an optical detection system configured to detect the wear marker and to generate a warning signal upon detection of the wear marker.

23. A substrate polishing method, comprising:

polishing one or more substrates against a polishing surface with a retaining ring having an inner surface exposed to contact a peripheral edge of the substrate, a bottom surface exposed to contact the polishing surface while the substrate is being polished, and a wear marker indicative of a preselected amount of wear of the bottom surface; and replacing at least a portion of the retaining ring when the bottom surface has been worn away by the preselected amount indicated by the wear marker.

24. A substrate polishing method, comprising:

polishing one or more substrate against a polishing surface with a substrate carrier that includes a substrate retaining ring with a wear marker indicative of a preselected amount of wear of the retaining ring; and generating a warning signal upon detection of the wear marker.

25. The method of claim 24, further comprising optically detecting the wear marker.

* * * * *